United States Patent [19]

Hittel et al.

[11] 4,399,670

[45] Aug. 23, 1983

[54] APPARATUS FOR TRANSFERRING WEFT THREADS IN A WRAP KNITTING MACHINE

[75] Inventors: Gerhard Hittel, Rodgau; Hand Fiedler; Hans Groh, both of Obertshausen, all of Fed. Rep. of Germany

[73] Assignee: Karl Mayer Textilmaschinenfabrik GmbH, Obertshausen, Fed. Rep. of Germany

[21] Appl. No.: 366,005

[22] Filed: Apr. 6, 1982

[30] Foreign Application Priority Data

Apr. 9, 1981 [DE] Fed. Rep. of Germany ..... 3114405

[51] Int. Cl.[3] ..... D04B 23/06

[52] U.S. Cl. ..... 66/84 A; 66/109

[58] Field of Search ..... 66/84 A, 85 A, 109

[56] References Cited

U.S. PATENT DOCUMENTS

| | | | |
|---|---|---|---|
| 1,924,649 | 8/1933 | Morton | 66/84 A X |
| 3,864,943 | 2/1975 | Wunner | 66/84 A |
| 4,255,947 | 3/1981 | Kohl | 66/84 A |

*Primary Examiner*—Ronald Feldbaum

*Attorney, Agent, or Firm*—Omri M. Behr

[57] ABSTRACT

There is provided a novel system for increasing the accuracy and delivery speed of weft thread insertion in warp knitting machines. The system includes a novel transport arrangement for providing magazine weft threads proximate to the needle bar and a knockover sinker bar whose knockover sinkers are operable to pass between the needle spaces to grip the weft thread.

The system is most suitably employed in a warp knitting machine producing a fabric containing an intermediate layer such as a non-woven fabric overlayed with weft threads. This machine comprises a needle bar, at least one guide bar and an arrangement for providing the intermediate layer between the needles and the guide bar.

11 Claims, 3 Drawing Figures

APPARATUS FOR TRANSFERRING WEFT THREADS IN A WRAP KNITTING MACHINE

BACKGROUND OF THE INVENTION

1. Field of the Invention

The present invention relates to a system of weft thread insertion and is particularly suited to warp knitting machines for producing a fabric overlayed with weft threads and also relates to apparatus for delivering these weft threads to a working area.

2. Discussion of the Relevant Art

In a known warp knitting machine of this type (see DDR PS No. 128617) a non-woven fabric is provided between two guide rails. Magazine weft threads are provided on both sides of this non-woven fabric by means of a transport arrangement which comprises two pairs of endless chains provided with grippers for holding the weft threads. This transport arrangement provides the weft threads right up to the needle bar. As the speed of the machine increases and the width of the machines increases, a certain instability affects these warp threads. When this occurs either a weft insertion is missed or two weft threads are inserted into one row of stitches, or else a weft thread is only inserted into a portion of a stitch row. However, if the weft threads are not provided in a predictable fashion, the fabric thus produced will show flaws.

A purpose therefore of the present invention is to provide a warp knitting machine of the type known to the art, so modified that the warp threads can be inserted without danger of fabric error.

SUMMARY OF THE INVENTION

A transfer means according to the principles of the present invention is employed in a warp knitting machine. It is particularly suitable for use with warp knitting machines which can provide a fabric having a stitched-through intermediate layer overlayed with magazine weft threads. The presence of the intermediate layer creates weft thread access problems in the working area, however, the solution presented by this invention is of general applicability. Such a machine includes a plurality of needles, at least one needle bar, at least one guide bar and an arrangement for providing the intermediate layer between the needle and guide bar. The transfer means includes a transport means for successively carrying the magazine weft threads toward the needle bar and a distributor for presenting the weft threads proximate to the needles. Also included is a knockover sinker bar mounted in the machine and operable to reciprocate therein. A plurality of knockover sinkers are mounted on the knockover bar and reciprocate therewith for periodically knocking over stitches formed by said needles. At least a predetermined number of these knockover sinkers have gripping means which pass between the needles for gripping an adjacent one of the weft threads presented to the rear side of the needles by the distributor. The knockover sinker bar can move upon a path between the first position and a second position. In the first position the gripping means, having passed between the needles, grips the adjacent one of the weft threads provided by the transport arrangement behind the needles. In the second position the gripping means brings the adjacent one of the weft threads into the needles.

By employing apparatus of the foregoing type, a highly reliable weft thread transfer is accomplished.

Preferably, at least some of the knockover sinkers are provided with the gripping means to grip the weft thread and in a first working position, the grippers (or hooks) grip the weft threads which are delivered behind the needle bar by a transport arrangement. In a second position these grippers actually provide the weft threads to the needles themselves and to this end, the knockover sinker bar is preferably provided with a forward and rearward motion. Thus in this form of construction, at least some of the knockover sinkers additionally acquire the function of warp thread provider means. This feature need not require additional room since it is combined with the knockover sinker function. The sinker motion can also be so provided so it does not collide with the intermediate layer (that may be a non-woven fabric). At the same time, the delivery end of the weft thread transport arrangement can be provided at a substantial distance away from the actual working area so that it provides no interference with the working cycle even though the intermediate layer must be provided to the working area at the same time. In this manner it is possible to provide the weft threads in a way which ensures even provision of the weft threads to the working cycle. This requires, nevertheless, that the knockover sinkers are provided with an additional movement. Such a movement may be readily provided without excessive constructive complications.

BRIEF DESCRIPTION OF THE DRAWINGS

In order that the invention may be more fully understood, it will now be described, by way of example, with references of the accompanying drawings in which.

DETAILED DESCRIPTION OF THE DRAWINGS

Figure 1:
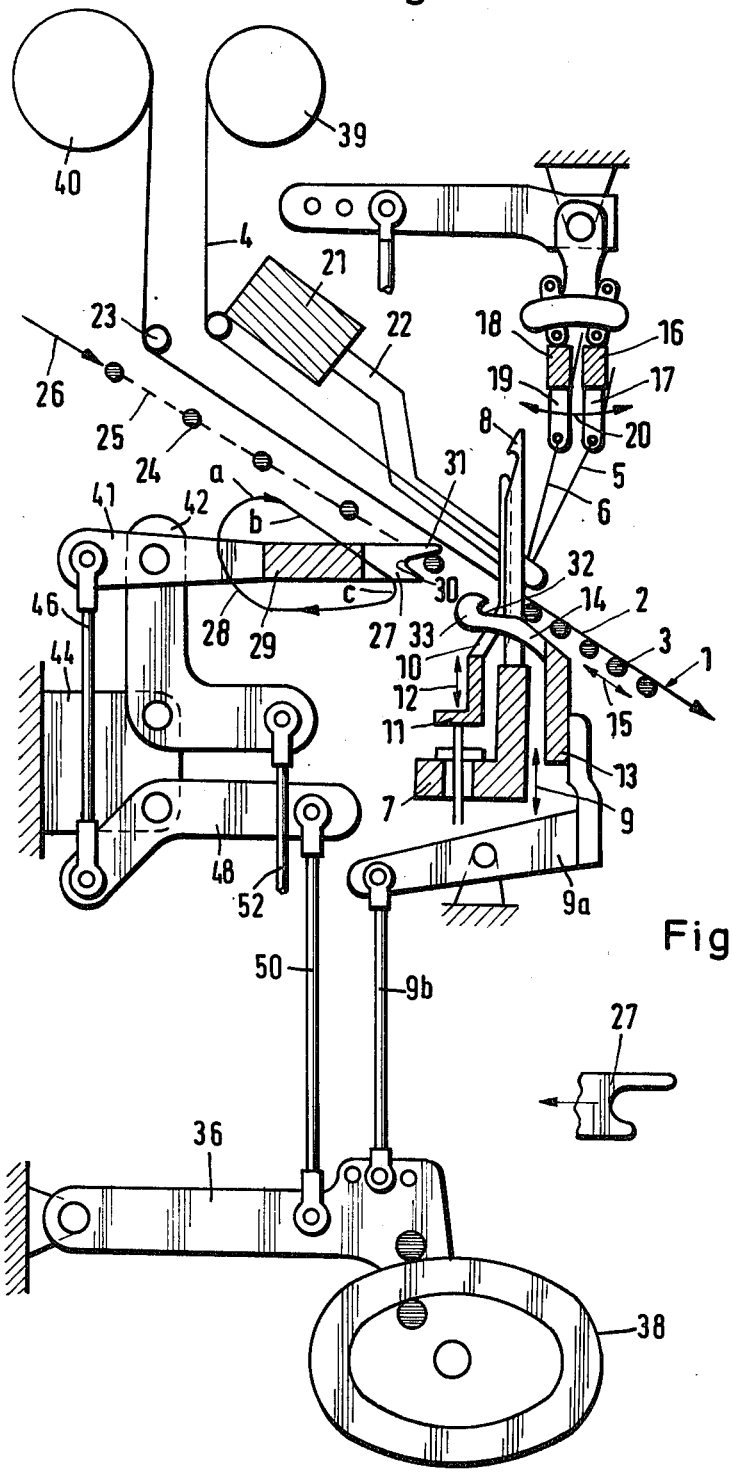
FIG. 1 is a schematic, elevational, cross-sectional view of the working area of a warp knitting machine in accordance with the present invention adapted to be used with an intermediate fabric layer.

The warp knitting machine of FIG. 1 is utilized for providing fabric 1 comprising an intermediate layer 2 such as a non-woven fabric having overlayed on one side magazine weft thread 3 and on the other side standing threads 4, together with stitch-forming warp threads 5 and 6 which penetrate the intermediate layer 2 and which are knotted into threads 3 and 4. In place of utilizing a non-woven fabric as the intermediate layer, individual standing threads or any other intermediate layer may be utilized.

A needle bar 7 carries a spaced plurality of parallel needles 8 and is acutated by a drive means 9 which reciprocates the bar upwardly and downwardly. Needles 8 operate in conjunction with corresponding sliders 10 attached to slider bar 11 provided with a drive means 12 which moves bar 11 upwardly and downwardly and relatively to needles 8 to open and close them in a conventional fashion. A knock-over sinker bar 13 carries a spaced plurality of knock-over sinkers 14 which move between and interdigitate with needles 8. Bar 13 is reciprocatably actuated by drive means 15, shown herein as a rocker 9a connected by connecting arm 9b near the free end of pivotally mounted arm 36. Arm 36 is lifted by rotatable cam 38 to provide sinkers 14 and bar 13 with a motion parallel to that of the pulled off fabric 1 in a back and forth direction as indicated by the arrows of drive means 15. Cam 38 can be rotated at a speed proportional to the cycling rate of needles 8. A guide bar 16 carrying thread guides 17 and a guide bar 18 carrying thread guides 19 serves for the provision of warp threads 5 and 6, respectively. These guide bars are swingable by the action of drive means 20 in the direction indicated by its arrows and may also be moved (shogged) in a direction in and out of the plane of the drawing. A hold down bar 21 carries a spaced, parallel, plurality of hold down guides 22 which at the same time provide through their apertured ends warp threads 4 delivered from beam 39. An intermediate layer 20, preferably a non-woven fabric, is fed from a storage roll 40 via direction changing roller 23 underneath guides 22. The magazine weft threads 24 are provided via transport means 25 (chains in this embodiment) actuated by drive means 26 in the direction indicated by its arrow into the vicinity of the working area at needles 8.

In a manner described further hereinafter weft threads 24 are taken over by thread distributors 27 which travel on a path indicated by closed loop 28, and are attached to bar 29. Each thread distributor 27 comprises a concave carrier surface 30 adjacent an upper nose 31. In a preferred embodiment of the present invention thread distributors 27 form the end of the transport arrangement. The transport surface 30 and nose portion 31 (which will protrude between the intermediate layer and the weft threads), in the first position of the grippers 33, runs in a path which provides a vector component in the direction of the needle bed. Grippers 33 are described further hereinafter.

Bar 29 is moved along path 28 by a pair of articulated arms comprising rocker 41 journalled on L-shaped rocker 42 whose corner is journalled on stationary bracket 44. Being thus mounted, bar 29 has two degrees of freedom. Rotation of rocker 41 is affected by connecting rod 46, spanning and pivotally coupled to the end of rocker 41 opposite bar 29 and to one end of dog-legged rocker 48. Its other end is pivotally connected to one end of connecting rod 50 whose other end is pivotally connected to lever 36 near cam 38. Rocker 48 is journalled at its corner to bracket 44. Connecting rod 52, similar to rod 50, connects to a cam (not shown) or other means to produce together with cam 38 the motion of path 28.

The path 28 is such that when travelling segment "a" nose 31 penetrates between two sequential weft threads 3. In path portion "b" these weft threads are transported by carrier surface 30 and in section "c" the distributors describe a path parallel to that of needles 8.

Figure 2:
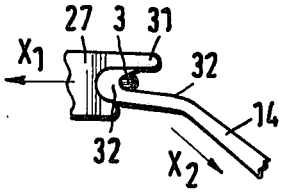
FIG. 2 is a partial, cross-sectional, elevational, schematic view of the thread distributor and the gripping means of FIG. 1 in a first position.
Figure 3:
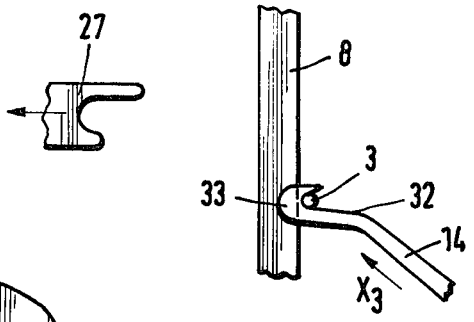
FIG. 3 is a partial, cross-sectional, elevational, schematic view of the thread distributor and the gripping means of FIG. 2 in a second position.

The knockover sinkers 14 in addition to their knockover surface 32 possess a gripping means 33 in the shape of a hook-formed protrusion. While it is particularly simple to provide the gripping means in the form of a hook-shaped protrusion 33 on the knockover sinkers 14, other shaped grippers are possible. In this embodiment it is not necessary to provide hooks 33 to each knockover sinker 14. They should merely be provided with a sufficiently small separation from each other that a regular provision of the weft thread is ensured. FIG. 2 shows that this gripping means 33 in this illustrated first position behind needle 8, takes over a weft thread 3 from thread distributor 27. This is accomplished by moving weft thread 3 beyond this gripper means 33 in section "b" of the travel path 28 and during segment "c" of the travel path, transporting thread 3 onto the knockover surface 32. It then, thread distributor 27 and the knockover sinker 14 and its gripping means 33 move away from each other in the directions of arrows X1 and X2 respectively, gripping means 33 carries the weft threads with it. This movement continues until the second position, shown in FIG. 3, in which the weft thread 3 finds itself in front of needle 8 and thus may be readily bound in with weft threads 5 and 6.

In operation, rods 50 and 52 will retract nose 31 to underneath weft threads 3, travelling in a direction opposing the thread motion, to allow the next thread to appear downstream of surface 30. Thereafter nose 31 is inserted between that next thread and the following one as segment "a" of path 28 is traversed.

As segment "b" of path 28 is followed thread 3 is caught in surface 30 and carried forward. Contemporaneously hook 33 moves backward so thread 3 lands on surface 32. Because of the relative movement in the direction of knitting needles 8, weft threads 3 are transferred from the thread distributor 27 to the gripper 33. As hook 33 and distributor 27 separate, following directions X2 and X1, respectively, the situation shown in FIG. 2 occurs. By this time slider needle 8 has closed and moved below sinker 14, accomplishing a knocking-over motion. Therefore sinkers 14 and their hooks 33 can move forward after which needles 8 rise to reach the configuration shown in FIG. 3. When the needles 8 next move downwardly in order to form the stitch, knockover sinker 14 has already been displaced in the direction of arrow X3 so that sinker surface 32 finds itself in the right position in order to knockover the stitch.

It is advantageous to provide hold down bar guides 22 for providing warp threads 4 which do not form stitches, on the side of intermediate layer 2 opposite needle bar 7. In this way intermediate layer 2 is held in position by guides 22 during the penetration of the layer by knitting needles 8. At the same time, on the side of intermediate layer 2 opposite weft threads 3, standing threads 4 (or warp insertion threads or other warp threads) which do not form stitches can be provided.

The foregoing describes a highly reliable apparatus that quickly transfers weft threads to a needle bed with a thread distributor handing off to hooked grippers. It is particularly possible to provide a closed path for the thread distributor which, after separation of the weft thread segment from the following weft thread segment, provides said weft thread segments substantial parallel to the needle bed. The knockover sinkers and their appropriate grippers need only move backwards and forwards on the same path although other paths are possible. This thread distributor makes it possible to provide the weft threads from the magazine at a lesser separation than was heretofore possible and the distributor can separate the weft threads from those following them and deliver them to the working area right at the end of the transport cycle. Because of the simultaneous use of the grippers as knockover sinkers, the motion path of the thread distributor can be terminated behind the needle bar. Thus it is possible to avoid every danger that the thread distributor will interfere with an intermediate layer such as the non-woven fabric.

It will be understood that various changes in the details, materials, arrangement of parts and operating conditions which have been herein described and illustrated in order to explain the nature of the invention may be made by those skilled in the art within the principles and scope of instant invention.

Having thus set forth the nature of the invention, what is claimed is:

1. A warp knitting machine for providing a fabric having magazine weft threads, said machine having:
   a plurality of needles;
   at least one needle bar;
   at least one guide bar;
   a drive means for reciprocatingly actuating said needle bar; and a weft thread transfer means comprising:
      a transport means for successively carrying said magazine weft threads toward said needle bar;
      a knockover sinker bar mounted in said machine and operable to reciprocate therein; and
      a plurality of knockover sinkers mounted on said knockover bar and reciprocatable therewith for periodically knocking over stitches formed by said needles, at least a predetermined number of said knockover sinkers having:
      gripping means passable between adjacent needles for gripping an adjacent one of said weft threads, said knockover sinker bar being movable upon a path between a first position in which the gripping means grips an adjacent one of the weft threads provided by said transport arrangement behind said needles, and a second position in which the gripping means bring said adjacent one of the weft threads into said needles.

2. A warp knitting machine according to claim 1 wherein said fabric comprises a stitched-through intermediate layer overlayered with said magazine weft thread, said machine further comprising an arrangement for providing said intermediate layer between said needle and guide bar.

3. A warp knitting machine according to claim 1 wherein said gripping means comprises:
   a hook-shaped protrusion projecting from each of said predetermined number of said knockover sinkers near their ends.

4. A warp knitting machine according to claim 3 wherein said predetermined number of knockover sinkers each have a knocking-over surface, said hook-shaped protrusion extending therefrom in a direction opposite to the direction of delivery of said weft threads and terminating in a hooked end having an upwardly curved portion.

5. A warp knitting machine according to claim 4 wherein said predetermined number of the knockover sinkers are evenly distributed among the others.

6. A warp knitting machine according to claim 1 wherein said transport means successively delivers said weft threads towards a location behind said needle bar, said transport means comprising:
   a plurality of thread distributors each having at its outer free end a transport surface and an adjacent nose element, said distributors being periodically operable to insert said nose element past said weft threads toward said needle bar.

7. A warp knitting machine according to claim 2 wherein said transport means successively delivers said weft threads towards a location between said intermediate layer and said needle bar, said transport means comprising:
   a plurality of thread distributors each having at its outer free end a transport surface and an adjacent nose element, said distributors being reciprocatably mounted in said machine and being periodically operable to insert said nose element past said weft threads toward said intermediate layer.

8. A warp knitting machine according to claim 7 wherein said transport surface of each of said distributors follows a path to engage an adjacent one of said weft threads and carry it in a direction having a vector component in the direction of said needles, said vector component existing as said gripping means arrives at said first position.

9. A warp knitting machine according to claim 8 wherein said transport surface of each of said distributors travels on a closed path, said closed path including a passage substantially parallel to said needles after engagement by said transport surface of one of said weft threads.

10. A warp knitting machine according to claim 9 wherein each of said distributors comprises:
   a pair of articulated arms, one being jointed to the other and to said machine.

11. A warp knitting machine according to claim 2 wherein said transfer means further comprises:
   a plurality of substantially parallel hold-down elements for providing to the side of said intermediate layer opposite said needle bar warp threads that are not stitched by said needles.

* * * * *